US008727011B2

(12) United States Patent
Parrish

(10) Patent No.: US 8,727,011 B2
(45) Date of Patent: May 20, 2014

(54) WELLHEAD TEST TOOL AND METHOD

(75) Inventor: Christopher J. Parrish, Houston, TX (US)

(73) Assignee: TAM International, Inc., Houston, TX (US)

( * ) Notice: Subject to any disclaimer, the term of this patent is extended or adjusted under 35 U.S.C. 154(b) by 1013 days.

(21) Appl. No.: 12/625,242

(22) Filed: Nov. 24, 2009

(65) Prior Publication Data

US 2011/0120720 A1 May 26, 2011

(51) Int. Cl.
*E21B 33/035* (2006.01)
*E21B 43/01* (2006.01)

(52) U.S. Cl.
USPC ..... 166/336; 166/337; 166/339; 166/367; 166/179

(58) Field of Classification Search
USPC ..... 166/336–339, 251, 367, 368, 250.01, 166/250.08, 250.17, 381, 387, 85.3, 179
See application file for complete search history.

(56) References Cited

U.S. PATENT DOCUMENTS 3,451,475 A * 6/1969 Price ..... 166/336
5,297,634 A * 3/1994 Loughlin ..... 166/387

* cited by examiner

*Primary Examiner* — James Sayre
(74) *Attorney, Agent, or Firm* — Adolph Locklar

(57) ABSTRACT

A method of pressure testing a lower marine riser package includes forming an inflatable packer having exposed slats and an inflatable packer element. The packer is positioned within the lower marine riser package above the cap seal with the exposed slats above the packer element. The packer is inflated and fluid pressure is then applied to test the integrity of the cap seal. The packer may be inverted, then positioned below the BOP/riser connection, the packer inflated, and pressure increased above the inflated packer element to test the fluid integrity of the BOP/riser connection.

15 Claims, 5 Drawing Sheets

WELLHEAD TEST TOOL AND METHOD

RELATED CASE

This application claims priority of U.S. 61/117,593 filed on Nov. 25, 2008.

FIELD OF THE INVENTION

The present invention relates to a method of pressure testing a lower marine riser package including a BOP/riser connection and a cap seal. More particularly, the present invention relates to the method of testing the lower marine riser package prior to installation of the subsea package.

BACKGROUND OF THE INVENTION

It has been widely accepted amongst those in the oil and gas industry that the era of easily available, "cheap" energy is over. In order to meet rapidly growing demand, it is becoming more and more necessary to move offshore in the search for conventional oil and gas plays. Since the feasibility of a well's production is driven largely by economic, rather than technical factors, it is very important to control costs as much as possible.

With the oil and gas industry increasingly looking for energy offshore, there will be increased costs associated with the complexity of drilling below the ocean floor in deeper water. A leak detected after latching the lower marine riser package (LMRP) in deep water can cost the rig and the energy producer up to a $12 million in lost time. There is a need to be able to test the BOP/riser connection and cap seal for pressure integrity at surface before the operator runs to depth with the LMRP.

SUMMARY OF THE INVENTION

A procedure is disclosed to test at surface for leaks inside the lower marine riser package, and primarily the cap seal (annular seal) at the lower marine riser package and the BOP/riser connection. All connections may be tested offline and do not interfere with drilling operations. The method is safe and economical since it uses field proven equipment and can be performed in a short time interval. A closed system is created in a BOP of the lower marine riser package using an external inflate (EI) tool.

The tool may be inflated insider the BOP above the cap seal. Pressure is then applied from below the tool to test this seal's integrity. The tool may then be inverted and placed higher up in the BOP in order to test any of the BOP/riser connections. In either position, by observing the applied pressure, it is possible to confirm the presence or absence of a leak, as well as its location. If testing detects the presence of a leak, the cause for the leak may be economically corrected.

In one embodiment, a method of pressure testing a lower marine riser package prior to installation in a subsea well includes forming an inflatable packer having an inflate port external to a packer mandrel, and having exposed slats and an inflatable packer element axially spaced from the exposed slats.

The packer may be lowered within the lower marine riser package to a position above the cap seal, with the exposed slats above the inflatable packer element. The packer may then be inflated against the internal well of the lower marine riser package above the cap seal, and fluid pressure increased below the inflated packer to test fluid integrity of the cap seal. The packer may also be lowered to a position below the BOP/riser connection, with the exposed slats below the inflatable packer element. The packer may be inflated against the internal wall of the lower marine riser package below the BOP/riser connection to set the packer. Pressure may be increased above the inflatable packer element to test fluid integrity of the BOP/riser connection.

These and further features and advantages of the present invention will become apparent from the following detailed description, wherein reference is made to the figures in the accompanying drawings.

DETAILED DESCRIPTION OF PREFERRED EMBODIMENTS

The cap seal and the BOP/riser connection of a lower marine riser package may be tested according to this invention "offline", e.g., at the moon pool. If a cost of $1 million/day is assumed for not only the rig but also the production company (standby time for personnel and equipment, for instance), it can cost a rig up to $12 million to correct a leak detected at the seabed (4 days to get to bottom, 4 days to pull riser, and another 4 days to go back down).

Figure 4:
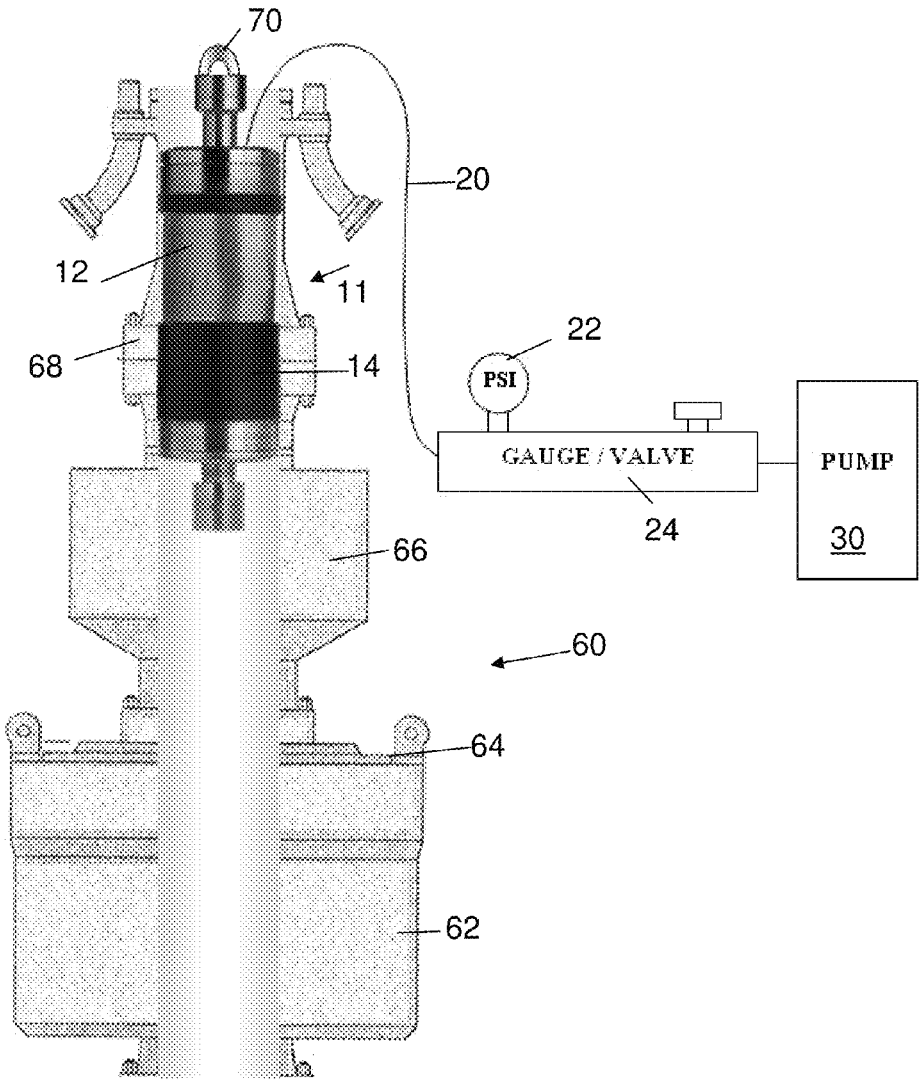
FIG. 4 is a pictorial view of the tool positioned for testing the annular cap seal of the lower marine riser installation.

The simplicity of the lower marine riser package test at surface lies in the short list of equipment used before the package is lowered subsea, as shown in FIG. 4:

7"×14½" external inflate (EI tool) 10

Stainless steel inflate lines 20 with pressure gauges 22

Rig Pump 30

Lower marine riser package 60, typically including BOP 62, annular cap seal 64, flex joint 66, and riser adapter 68

A similar external inflate tool has been used extensively in applications presenting IDs of from 16" to 30", as a bridge plug, casing hole finder, and on cement squeeze jobs.

Figure 1:
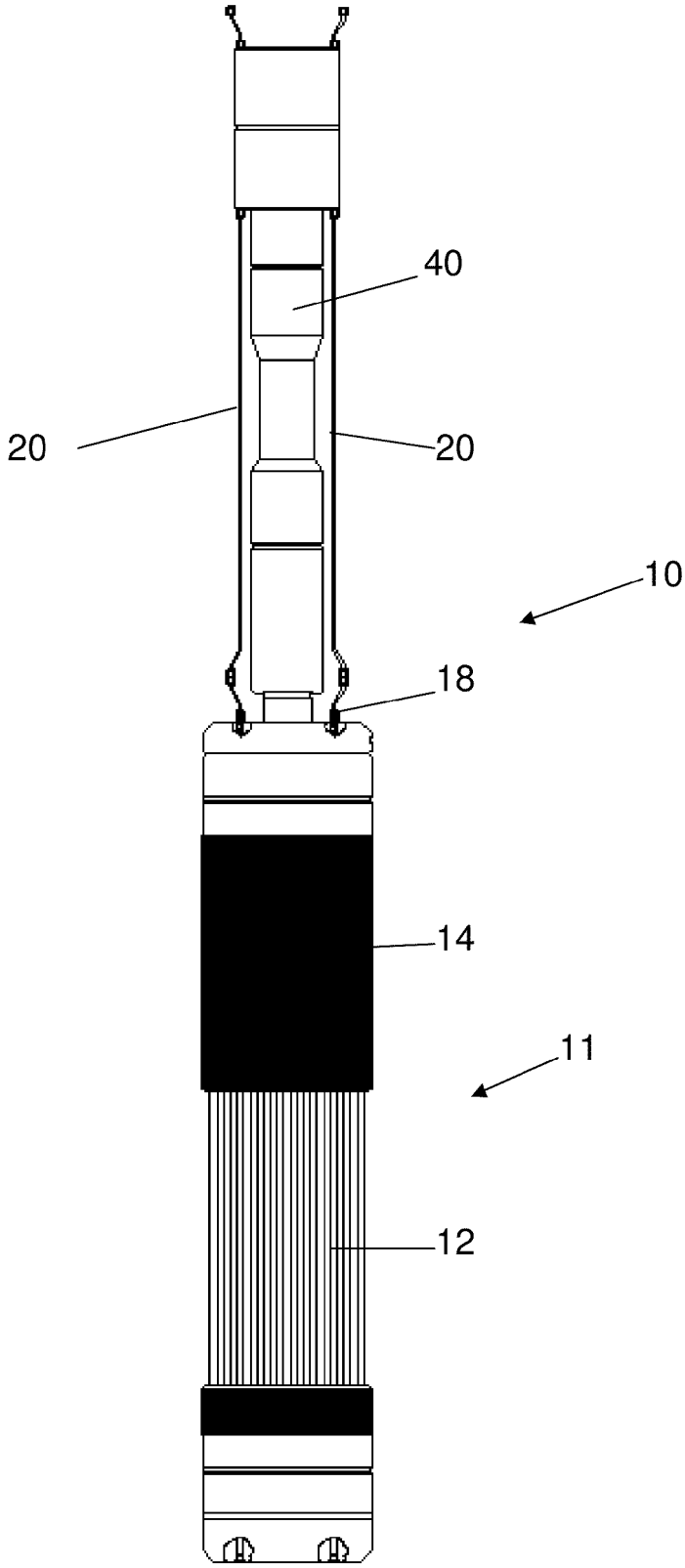
FIG. 1 is a side view of a tool configured for testing the fluid integrity of the cap seal.
Figure 2:
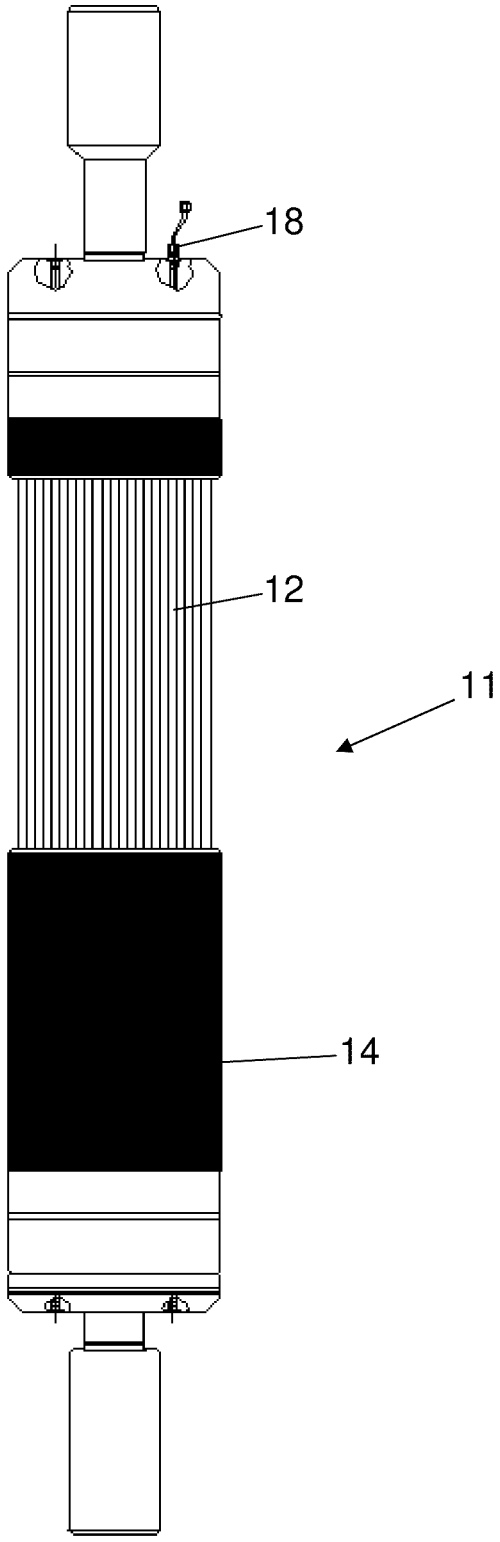
FIG. 2 is a side view of the tool configured for testing the BOP/riser connection.

There are two distinct parts of the external inflate (EI) tool. As shown in FIG. 1, the exposed metal anchoring slats 12 are provided at one end. Due to the metal-to-metal slat/BOP ID contact, these slats act like "slips" or grippers when the element is inflated. Below the slats in FIG. 2 is the rubber seal element 14. This exposed rubber element does provide some measure of holding force, although its main purpose is to create a seal within the BOP.

Providing a tool which uses an inflatable sealing element has significant advantages compared to other types of sealing techniques. The inflatable element is particularly well-suited for reliable sealing with different sized internal bores and different internal ID profiles. Lower mariner riser packages commonly have a central bore which may vary in diameter from about 16 inches to about 22 inches. The same inflatable element is able to reliably seal with the bore of marine riser packages which are manufactured by different companies and typically have different diameters. Also, the inflatable tool may be reliably anchored within the lower marine riser package in order to conduct a pressure test using the exposed slats discussed above. The tool may be positioned, inserted and inflated, and a pressure test conducted in a relatively short time period. Additional inflate ports may be provided compared to a conventional packer, with ports provided the upper end of the tool regardless of whether the tool is inverted. Also, additional ports may be provided at each end to decrease the time required to inflate the packer element.

Since this test deals with high pressure applied to a large piston area, it is necessary to take measures to conduct the test safely. The external inflate packer has a long service history, and its behavior is highly predictable. Although pressure tests may present safety concerns, the proven nature of the tool combined with the observed safety precautions mitigated many of these concerns.

In addition to not requiring much equipment, each test case (slats up or slats down) is extremely simple to carry out, as illustrated by the following test programs.

Test 1: Slats Up, Testing Cap Seal

1. Install packer 11 with slats 12 upward and crossover to work string, for instance:
   a) Drillpipe with lifting pup
   b) Crane with lifting strap
2. Install inflation tubing in connection on top of packer.
3. Run packer 11 into BOP above cap seal 64; route inflation line 20 from fitting 18 at the top of the packer to the packer inflation pump 30.
4. With packer at proper set depth, install pressure gauge 22 and shut off valve 24 to inflate line. See FIGS. 2 and 4.
5. Connect inflate line 20 to pump 30. Slowly inflate packer to a predetermined pressure, based on:
   a) BOP ID
   b) Desired test pressure The combination of inflate/test pressures for a given BOP ID may be listed in a set of charts.

6. Hold pressure for an amount of time determined by the rig operator, and ensure no pressure fall off is seen during test.
7. To release packer, bleed off applied pressure, open shut off valve to allow packer to fully deflate.

A lifting eye 70 is provided at the upper end of the mandrel for manipulating the tool in place.

Test 2: Slats Down, Testing Bop/Riser Connection

Figure 3:
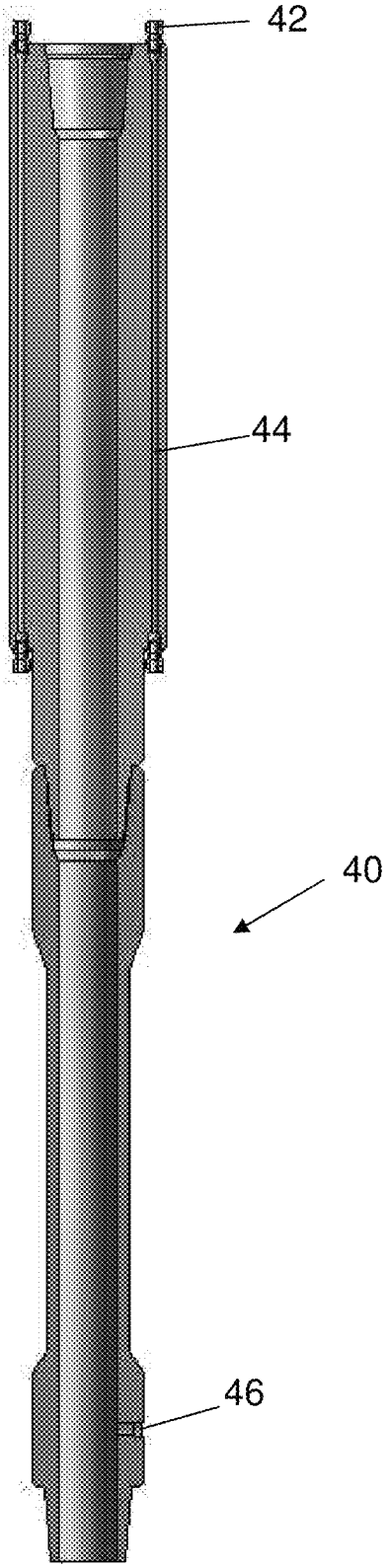
FIG. 3 is a cross-sectional view of the pup joint generally shown in FIG. 1.

1. Install packer 11 with slats downward 12 and crossover to work string, for instance:
   a) Drillpipe with lifting pup
   b) Crane with lifting strap
2. Install inflation tubing in connection on top of packer. For this, a feed through control line pup joint 40 is used.
3. Run packer into BOP below annular seal 64. The packer 11 may conveniently be positioned below the lower annular BOP 74 and below the riser connector 76. Route inflation line from the top of the feed through sub 40 to fitting 42 and flowline 44. The lower end of this line may be connected to fitting 18 at the top of the packer, as shown in FIG. 3. The correct space out of feed through control line pup joint 40 may be ensured in this manner. The tool rests on the partially closed rams 72, and flow port 46 in sub 40 for pressurizing the annulus above the set packer.
4. With packer at proper set depth, install pressure gauge 22 and shut off valve 24 to inflate line.
5. Connect inflate line to pump 30. Slowly inflate packer to predetermined pressure, based on:
   c) BOP ID
   d) Desired test pressure The combination of inflate/test pressures for a given BOP ID is listed in the charts.

6. Hold pressure for an amount of time determined by the rig operator, and ensure no pressure fall off is seen during test.
7. To release packer, bleed off applied pressure, open shut off valve to allow packer to fully deflate.

This test was performed several times, and each time the inflate pressure, and that applied below the tool were varied, as summarized in the following table.

TABLE I

| Inflate Pressure (psi) | Pressure Applied Below Tool (psi) |
|---|---|
| 1500 | 1000 |
| 1800 | 1500 |
| 2000 | 1800 |

The readings for pressure applied below the tool were taken when the packer movement was observed. At this point, the inflate pressure was increased, and pressure was reapplied below until the packer again started to slide.

This posed the only significant safety issue: the possibility of the packer being ejected from the BOP due to the very large piston area on which the applied force acted. However, when slight packer movement upwards was observed, the pressure at this point was escaping between the packer and the BOP ID, allowing the system to bleed itself back to equilibrium (and keep the packer in the BOP). In addition, the volume underneath the packer was not large enough to provide for a catastrophic failure. Finally, since pressure was being increased gradually, the risk of a sudden, catastrophic failure was mitigated.

Test Findings

Four test runs were conducted, and the results were highly conclusive.

Test 1: Inflated tool to 1500 psi and applied 1000 psi pressure below.

Result: Leak detected at lower flange. Since the very purpose of the test was to detect leaks at the BOP/riser connection, the first run proved very successful. After the flange bolts were tightened, test run 2 was initiated.

Test 2: Again inflated tool to 1500 psi and applied 1000 psi of pressure under the tool. The goal here was to see if the packer would hold pressure, thus confirming that the leak had indeed been fixed.

Result: Pressure was held for 20 minutes then bled off.

Test 3: Tool inflated to 1800 psi, pressure of 1500 psi applied below the tool.

Result: Pressure held for 10 minutes then bled off.

Test 4: Deflated and removed tool from BOP, inspected the tool, and restabbed into the BOP. Tool was inflated to 2000 psi, and a pressure of 1800 psi was held below the tool.

Result: One purpose of this test run was to demonstrate how fast the test could be performed. Not only did the pressure hold just as well as in previous runs, but also the test took only 28 minutes to perform from start to finish.

Modifications to the Tool

Modifications to the original EI tool were made to increase its versatility when being used for this application.

- The height of the cap at the end of the tool may be adjusted so that it may be used as a locator on top of the shear rams inside the BOP.
- The number of inflate/deflate lines at both ends of the tool was increased.

FIG. 1 shows the tool as configured during the BOP/riser connection test. The most important aspect of the schematic is the depiction of the slats on the top side of the tool (the slats are positioned up or down if the pressure is applied from below or above, respectively).

In FIG. 2, the packer is turned over and pressure is applied from above through the perforated pup joint 16 (slats should always be positioned "opposite" the direction of the pressure). This configuration allows testing of the BOP/riser connections. The bottom of the tool is flat to use as a locator against the shear rams.

If the circumferential spacing of the slats were decreased and the length of the slats were increased, the tool should be capable of reliably withstanding a test pressure of up to 20,000 psi within the lower marine riser package. The tool conveniently may be fabricated such that a box thread is provided at each end of the mandrel, so that each end may be connected with a threaded tubular. As shown in the figures, a lifting eye may also be added to the box end of the tool to assist in tool handling. Various types of valves may conventionally be provided for closing off flow through the tool, including a bull plug.

With costs for offshore oil and gas development rising as sources of hydrocarbons become harder to produce, it is possible to use proven equipment in innovative ways in order to reduce the costs of offshore operations. Safety offshore is of primary importance. Rig crews can be trained in the redressing and operation of the tool, negating the need for additional personnel on the rig. The fewer people on the rig, the safer operations can be performed. The use of equipment in new applications also presents benefits, since the behavior of the tool should be known and predictable.

Figure 5:
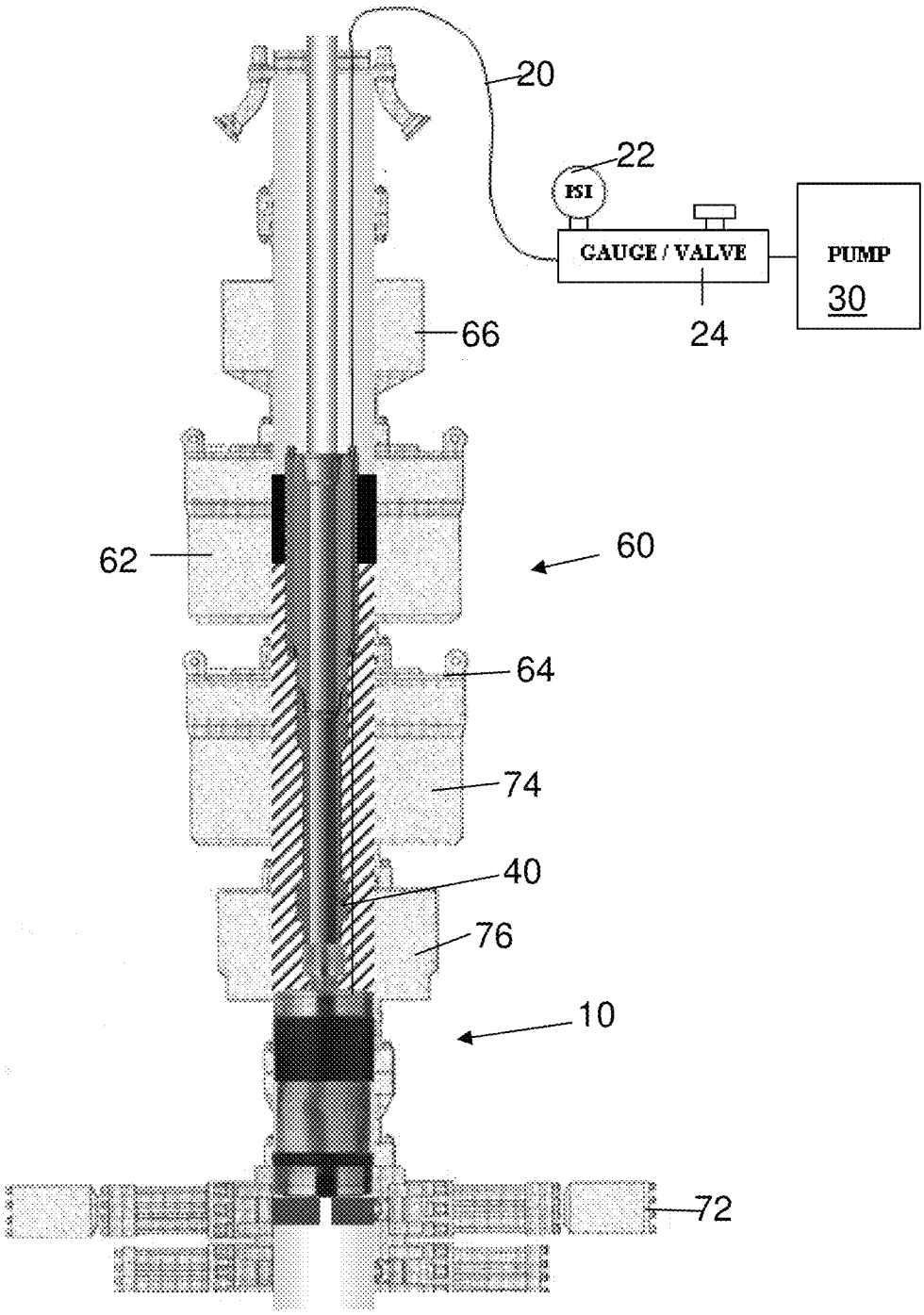
FIG. 5 is a pictorial view of the tool positioned for testing a BOP/riser connection.

An inflatable packer element as disclosed herein has a wide range of sealing diameters. The metal slats also may be radially expanded to grip with the interior of the package over a wide range of diameters. The tool of the present invention is particularly universal in its ability to test various size riser packages manufactured by various companies. When the package is made up at the well site for the first time, the tool may be used to effectively test ten to fourteen potential seals. This one tool thus effectively eliminates numerous specialty tools and caps previously used to test particular seals for a particular sized package by a particular manufacturer. The tool may be inverted so that test pressure may be applied from below as shown in FIG. 4, so that the slats are above and thus downstream from the sealing element, while the slats are beneath and thus downstream of the sealing element as shown in FIG. 5 when pressure is applied from above.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A method of pressure testing a lower marine riser package prior to installation in a subsea well, the lower marine riser package including a BOP/riser connection and a cap seal, the method comprising:

forming an inflatable packer having an inflate port external to a packer mandrel, and having exposed slats and an exposed inflatable packer element axially spaced from the exposed slats;

lowering the packer within the lower marine rise package to a position above the cap seal, with the exposed slats axially spaced from the exposed inflatable packer element;

thereafter inflating the packer against the internal wall of the lower marine riser package above the cap seal to set the packer; and thereafter increasing fluid pressure below the inflated packer to test the fluid integrity of the cap seal.

2. The method as defined in claim 1, comprising:

using one or more pressure gauges for testing fluid pressure retained by the set packer.

3. The method as defined in claim 1, further comprising:

providing ports external to the packer mandrel at each end of the packer to inflate the exposed packer element.

4. The method as defined in claim 1, further comprising:

providing a pup joint above the packer for sealing with annular rams of a lower marine riser package and providing a flow port from an upper tubular to an annulus between the set packer and the annular rams.

5. The method as defined in claim 1, wherein fluid pressure to inflate the packer is supplied from a rig pump.

6. A method of pressure testing a lower marine riser package prior to installation in a subsea well, the lower marine riser package including a BOP/riser connection and a cap seal, the method comprising:

forming an inflatable packer having an inflate port external to a packer mandrel, and having exposed slats and an exposed inflatable packer element axially spaced from the exposed slats;

lowering the packer within the lower marine riser package to a position below the BOP/riser connection, with the exposed slats below an exposed inflatable packer element;

thereafter inflating the packer against the internal wall of the lower marine riser package below the BOP/riser connection to set the packer; and thereafter increasing the pressure above the inflatable packer element to test the fluid integrity of the BOP/riser connection.

7. The method as defined in claim 6, further comprising:

using one or more pressure gauges for testing fluid pressure retained by the set packer.

8. The method as defined in claim 6, further comprising:

providing ports external to the packer mandrel at each end of the packer to inflate the packer element.

9. The method as defined in claim 6, further comprising:

providing a pup joint above the packer for sealing with annular rams of the lower marine riser package and providing a flow port from an upper tubular to an annulus between the set packer and the annular rams.

10. The method as defined in claim 9, further comprising:

lowering the packer to engage BOP rams and thereby position the packer and the pup joint at a desired level within the lower marine riser package.

11. The method as defined in claim 6, wherein fluid pressure to inflate the packer is supplied from a rig pump.

12. A method of pressure testing a lower marine riser package prior to installation in a subsea well, the lower marine riser package including a BOP/riser connection and a cap seal, the method comprising:

forming an inflatable packer having an inflate port external to a packer mandrel, and having exposed slats and an exposed inflatable packer element axially spaced from the exposed slats;

lowering the packer within the lower marine riser package to a position above the cap seal, with the exposed slats spaced axially from the inflatable packer element;

thereafter activating a rig pump to inflate the packer against the internal wall of the lower marine riser package above the cap seal to set the packer;

thereafter increasing fluid pressure below the set packer; and using one or more pressure gauges for testing fluid pressure retained by the set packer.

13. The method as defined in claim 12, further comprising providing ports external to the packer mandrel at each end of the packer to inflate the exposed packer element.

14. The method as defined in claim 12, further comprising providing a pup joint above the packer for sealing with annular rams of the lower marine riser package and providing a flow port from an upper tubular to an annulus between the set packer and the annular rams.

15. The method as defined in claims 14, further comprising lowering the packer to engage BOP rams and thereby position the packer and the pup joint at a desired level within the lower marine riser package.

* * * * *